US006513667B2

(12) United States Patent
Battaglia et al.

(10) Patent No.: US 6,513,667 B2
(45) **Date of Patent: *Feb. 4, 2003**

(54) SHELF ASSEMBLY HAVING PRODUCT HOLDERS

(75) Inventors: Joseph M. Battaglia, Douglasville, GA (US); Rafael T. Bustos, Atlanta, GA (US)

(73) Assignee: L&P Property Management Company, South Gate, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/858,056

(22) Filed: May 15, 2001

(65) Prior Publication Data

US 2001/0020605 A1 Sep. 13, 2001

Related U.S. Application Data

(62) Division of application No. 09/574,076, filed on May 18, 2000, now Pat. No. 6,276,538, which is a continuation of application No. 09/168,647, filed on Oct. 8, 1998, now abandoned.

(60) Provisional application No. 60/062,020, filed on Oct. 10, 1997.

(51) Int. Cl.[7] ..... A47F 1/04

(52) U.S. Cl. ..... 211/59.2; 211/74; 312/405.1; 108/108

(58) Field of Search ..... 211/59.2, 24, 183, 211/184, 43, 100, 75; 312/42, 45, 72, 234.4, 234.5, 405.1, 321.5, 128; 108/108

(56) References Cited

U.S. PATENT DOCUMENTS

| | | | | |
|---|---|---|---|---|
| 1,015,722 A | | 1/1912 | Bezold | |
| 1,205,844 A | | 11/1916 | Berry | |
| 1,439,534 A | | 12/1922 | Thompson | |
| 1,715,276 A | | 5/1929 | Burns | |
| 1,841,926 A | | 1/1932 | Zuehl | |
| 2,218,444 A | | 10/1940 | Vineyard | |
| 2,572,090 A | | 10/1951 | Allen | |
| 2,668,648 A | | 2/1954 | Carlsen | |
| 2,730,825 A | | 1/1956 | Wilds | |
| 3,240,351 A | | 3/1966 | Weiss et al. | |
| 3,528,558 A | * | 9/1970 | Williams | 211/49.1 |
| 3,568,851 A | | 3/1971 | Schafer | |
| 3,733,007 A | | 5/1973 | Ungerman | |
| 3,743,137 A | | 7/1973 | Bennett | |
| 4,064,992 A | | 12/1977 | Ralston et al. | |
| 4,186,978 A | | 2/1980 | Thomson | |
| 4,269,326 A | | 5/1981 | Delbrouck | |
| 4,560,072 A | | 12/1985 | Burell | |
| 4,598,828 A | | 7/1986 | Young et al. | |
| 4,616,891 A | | 10/1986 | Jantzen | |
| 4,682,825 A | | 7/1987 | Crosslen | |
| 4,685,574 A | | 8/1987 | Young et al.. | |
| 4,798,425 A | | 1/1989 | Armstrong et al. | |
| 4,809,855 A | | 3/1989 | Bustos | |
| 4,809,879 A | | 3/1989 | Hanley | |
| 4,872,567 A | | 10/1989 | Bustos | |
| 4,960,210 A | | 10/1990 | Spamer | |
| 5,119,945 A | | 6/1992 | Wiggins | |
| 5,160,051 A | | 11/1992 | Bustos | |

(List continued on next page.)

*Primary Examiner*—Daniel P. Stodola
*Assistant Examiner*—Khoa Tran
(74) *Attorney, Agent, or Firm*—Wood, Herron & Evans, LLP

(57) ABSTRACT

A shelf assembly for organizing and merchandising a plurality of products. The shelf assembly comprises a shelf supporting a plurality of product holders. Each product holder comprises a bottom, a pair of dividers and a front member secured to the dividers. The front member is pivotal about a horizontal axis and prevents the forwardmost product within a column of products from falling off the front of the shelf. The pivotal front member enables product to be pulled forwardly and minimizes the spacing necessary between adjacent shelves.

6 Claims, 5 Drawing Sheets

U.S. PATENT DOCUMENTS 5,197,610 A 3/1993 Bustos
5,205,421 A 4/1993 Bustos
5,314,078 A 5/1994 Morikiyo et al.
5,351,838 A 10/1994 Flum
5,379,905 A 1/1995 Bustos et al.
5,445,452 A 8/1995 Kauffman et al.
5,531,336 A 7/1996 Parham et al.
5,567,029 A 10/1996 Haenisch et al.
D376,709 S 12/1996 Markson
D378,254 S 3/1997 Markson
5,614,288 A 3/1997 Bustos
5,624,042 A 4/1997 Flum et al.
5,645,176 A 7/1997 Jay
5,673,801 A 10/1997 Markson
5,788,090 A 8/1998 Kajiwara
5,791,516 A 8/1998 Wittern, Jr. et al.
5,806,712 A 9/1998 Siemsen et al.
5,860,535 A 1/1999 Brown
6,149,031 A 11/2000 Bauman et al.
6,276,538 B1 * 8/2001 Battaglia et al. ..... 211/59.2

* cited by examiner

SHELF ASSEMBLY HAVING PRODUCT HOLDERS

RELATIONSHIP TO OTHER APPLICATIONS

This application is a division of U.S. application Ser. No. 09/574,076 entitled "Shelf Assembly" filed May 18, 2000, now U.S. Pat. No. 6,276,538, which application is fully incorporated herein. Application Ser. No. 09/574,076 is a continuation application of application Ser. No. 09/168,647 entitled "Shelf Assembly" filed Oct. 8, 1998 now abandoned, which application is fully incorporated herein. Application Ser. No. 09/168,647 claims priority to U.S. provisional patent application Ser. No. 60/062,020 filed Oct. 10, 1997 entitled "Shelf Insert", which is fully incorporated by reference herein.

FIELD OF THE INVENTION

This invention relates to display racks for supporting and displaying a plurality of products. More particularly, this invention relates to a shelf assembly adapted to be used in a display rack for organizing and merchandising a plurality of products.

BACKGROUND OF THE INVENTION

Merchants commonly display their products in shelved structures. In order to provide product at the front of the shelves, the shelves are commonly sloped downwardly so that gravity forces the product to the forward edge of the shelves where it is easily accessible to consumers. The angle of the shelf determines the amount of force gravity will have on the product so that the product moves forward.

Such inclined shelves are commonly divided into a plurality of tracks or channels parallel to the side edges of the shelves with dividers so that the product is displayed in orderly columns extending from back to front of the shelf. The tracks or channels are defined by the bottom of the shelf and a plurality of dividers extending upwardly from the shelf bottom. The dividers may be integrally formed with the shelf or separately formed and movable along the shelf bottom. Additionally, the dividers may be integrally formed in a shelf insert, such as the one disclosed in U.S. Pat. No. 5,614,288 issued to the assignee of the present application. Arranging the products in columns enables the merchant to display different products in different columns without multiple products being located in the same track or column.

Plastic inserts such as the one disclosed in U.S. Pat. No. 5,614,288 may be placed on a planar shelf in order to provide the shelf with means to divide the product into different columns for display purposes. These plastic inserts are typically of unitary construction and are commonly made of extruded or molded plastic. Dividers are an integral part of the insert and divide the insert into a plurality of tracks, a pair of dividers and the bottom of the insert defining a track. A plurality of stops or bumpers found at the front of the shelf insert are fixed to pairs of dividers at the front of the dividers in order to prevent product from falling off the front edge of the shelf. Once the forwardmost bottle is removed from the track, the remaining bottles within the track slide forwardly until the frontmost bottle contacts the bumper stop.

U.S. Pat. No. 5,351,838 discloses a shelf insert having a front wall shaped so as to form a plurality of inverted arches defining a plurality of openings therebetween. The front wall acts as a bumper stop for holding and retaining products positioned within the tracks or channels formed by the dividers and bottom of the shelf insert. The front wall prevents product from falling off the front of the shelf. A stop member may be inserted into slots cut in the upper portions of the front wall in order to further prevent product from passing through the openings in the front wall of the insert.

U.S. Pat. No. 5,645,176 discloses a one-piece elongate channel of unitary construction formed in a single plastic molding operation. A plurality of such elongate channels may be connected to each other and secured to a shelf in order to create a plurality of tracks extending front to back on the shelf, each track being defined by a pair of upstanding sidewalls and a bottom member. At the front of the sidewalls, a front member spaced above the bottom of the track connects the sidewalls and acts as a bumper stop preventing the forwardmost product in a column of products from falling off the shelf. This front member is sufficiently narrow in construction so as to define with the sidewalls and bottom of the track a generally rectangular aperture through which a substantial portion of the front or lead article in the channel may be viewed by a potential customer. Although this patent does disclose an aperture through which a consumer may view a portion of the forwardmost product in a track, the customer may not always see the label due to rotation of the products as they move down the track. In addition, the customer must lift the forwardmost product in the column over the bumper stop or pivot the forwardmost product over the top of the bumper stop while pushing all of the other products in the column rearwardly in order to remove the forwardmost product.

Gravity feed shelves may be used in refrigerated units such as coolers and non-refrigerated display racks. Typically, non-refrigerated display racks display larger bottles of product, such as two liter bottles, and are located along the sides of aisles in stores. Coolers or refrigerated units typically display smaller bottles of product, such as twenty-ounce bottles and are located near the checkout counter or register of a grocery or convenience store.

In both non-refrigerated and refrigerated display racks, a finite amount of vertical space is available for shelving. The more shelves can be placed within this finite area, the better from a merchant's standpoint because the merchant can display more product. In addition, the more shelves within the area, the less frequently the merchant needs to restock the display rack. Therefore, merchants desire display racks having the maximum possible number of shelves which are able to fit within a defined area.

Until the present invention, adjacent shelves generally were spaced vertically apart from one another by a distance equivalent to or greater than the height of the product being displayed plus the distance between the bottom of the shelf and the bumper stop, because when a consumer wanted to remove the forwardmost product located within a track on the shelf, he or she generally would lift the forwardmost product up over a bumper stop at the front of the track. Therefore, adjacent shelves generally were separated vertically from one another a sufficient distance so as to enable customers to remove the forwardmost products within the tracks by lifting the product vertically. The area between adjacent shelves required for customers to remove product is wasted space because it does not hold or store product. Thus, any type of shelf or shelf insert with immobile fixed bumper stops generally required a vertical spacing between shelves of at least the height of the product being displayed plus the height between the bottom of the shelf and the bumper stop at the front of each track. Such self spacing is undesirable because it decreases the packout or volume of product being displayed within a confined area.

Another difficulty with shelves or shelf inserts having fixed bumper stops is that as product slides down the shelf in the tracks, the product may twist about a vertical axis, inherently causing the labels on the bottles to turn. Therefore, once the forwardmost product contacts the bumper stop, the label of the forwardmost product is facing sideways or rearwards rather than forwardly. Consequently, the consumer has to twist the forwardmost product in a track in order to read its label in order to determine whether the product is the particular product the consumer wants.

In addition, product located on the upper shelves of a shelved structure such as, for example, a non-refrigerated display rack is difficult for some customers to remove because in order to remove the forwardmost product within a track, the product generally was lifted vertically over the fixed bumper stop located at the front of the track. Product located on the uppermost shelf of a display rack was difficult for a consumer whose reach is equal to or less than the height of the uppermost shelf of the display rack. Therefore, the height of a display rack in which merchants may display their products was limited to approximately the height of the reach of the consumers.

The present invention increases the height at which uppermost shelves of a display rack which contain product may be located because customers no longer must lift the product vertically above a fixed stop located at the front of the tracks of the shelf. The uppermost shelf of a display rack may be placed higher than heretofore possible because customers may pull product forwardly about a lower pivot axis rather than lifting product vertically up over a bumper stop.

It has therefore been one objective of the present invention to provide a shelf assembly divided into a plurality of tracks, each track having a pivotal front member.

It has been a further objective of the present invention to provide a shelf assembly which has a plurality of pivotal front members enabling product to be more easily removed by pulling product forwardly rather than lifting product upwardly or pulling the top of a product over the top of a fixed bumper stop.

It has been a further objective of the present invention to provide a shelf assembly which reduces the vertical distance between adjacent shelves necessary to remove products from intermediate shelves.

It has been a further objective of the present invention to provide a shelf assembly having a pivotal front member at the front of a track which is adapted to display different product identifying elements.

SUMMARY OF THE INVENTION

The invention of this application which accomplishes these objectives comprises a display rack to which are attached a plurality of shelf assemblies. Each shelf assembly functions to organize and merchandise a plurality of products arranged in columns extending from front to back of the shelf. The shelf assembly comprises a shelf having a bottom, a plurality of dividers and at least one front member movable relative to the dividers.

The dividers are spaced apart from one another and extend from front to back of the shelf so that a pair of the dividers and the bottom of the shelf define a track which supports a plurality of products arranged in a column. The forwardmost product within the column abuts against the front member. The front member prevents the products within the track from falling off the front of the shelf. The front member is pivotal about a horizontal axis so that a forwardmost product within a track may be removed by pulling the forwardmost product forwardly rather than lifting the forwardmost product over a fixed non-pivotal bumper stop as has been necessary before the present invention.

The dividers may be generally planar dividers or any other form of divider. The dividers extend from front to back on the shelf and may be movable relative to the shelf bottom or fixedly secured to the shelf bottom. Alternatively, the dividers may be part of a unitary one-piece shelf insert, such as is disclosed in U.S. Pat. No. 5,614,288.

If planar dividers are utilized in accordance with the present invention, each divider may have one or more holes which pass through the divider at the front of the divider. The holes are sized so as to receive a portion of one of the pivotal front members so the front member may pivot relative to the dividers. Alternatively, the dividers may have one or more receptacles integrally formed in the dividers. These receptacles are sized so as to receive a portion of one of the front members. When the front member is engaged with the receptacles formed in the dividers, the front member may pivot about a horizontal axis so that a consumer may remove a forwardmost product from a track by pulling the forwardmost product forwardly. In this embodiment, projections extending outwardly from the front member define the horizontal axis about which the front member pivots.

The front member is generally arcuate and is adapted to receive a beverage container, such as a bottle or can. Additionally, the front member is adapted to receive and display different product identifying elements. The front member may be one ply of plastic, or alternatively, two plies of plastic between which a product identifying element may be inserted in order to identify product within the track behind the pivotal front member.

In another embodiment of the present invention, the shelf assembly is divided into a plurality of tracks, each track having a fixed stop which acts as a bumper at the front of the track. The stop is fixedly secured to a pair of adjacent dividers. In this embodiment, the front member is pivotally secured to the stop rather than being pivotally secured to the dividers. Consequently, the front member pivots with respect to the fixed stop. The stop itself does not pivot relative to the dividers. Rather, the front member pivots about an axis defined by portions of the stop. In this embodiment, the forwardmost product within a track may still be removed by pulling rather than lifting the forwardmost product within the track. However, the forwardmost product must slide over the stop fixedly secured to the dividers at the front of the track. The stop may be a wire, a piece of plastic or any other structure about which the front member may pivot. The front member may be engaged with the stop any number of ways. One type of front member has a pair of openings therethrough which are adapted to receive the stop, enabling the front member to pivot about the stop. This embodiment is most often used with a wire grid structure, although is not necessarily so limited.

With either embodiment, the forwardmost product of a column of products may be removed from a track by pulling on the top of the product (i.e., the neck of a bottle) to pivot the forwardmost product about a pivot axis lower than the top of the bumper stop rather than lifting the product or pivoting the product over the top of a fixed bumper stop located at the front of the track. Thus with the present invention, adjacent shelves may be placed closer together than has heretofore been possible, increasing the packout or number of shelves which may be used within a limited space. Consequently, the present invention enables a merchant to store and display more product in a limited area. In addition, the pivotal front members located at the front of the shelf of the present invention enable customers to easily remove product and to easily identify products within the different tracks of the shelf. These and other objects and advantages of the present invention will be more readily apparent from the following description of the drawings.

DETAILED DESCRIPTION OF THE DRAWINGS

Figure 1:
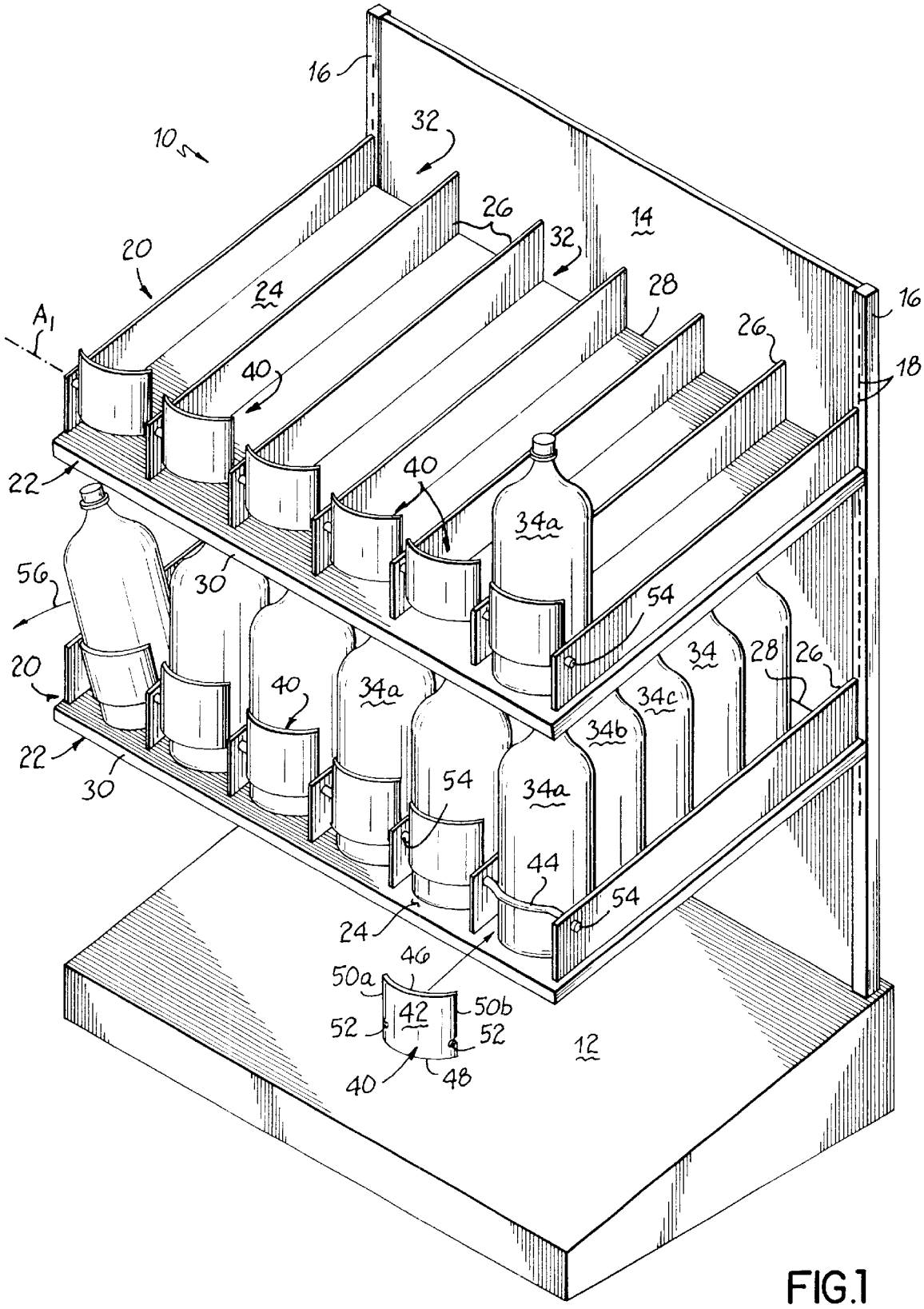
FIG. 1 is a perspective view of the display rack of the present invention illustrated with two shelves, each shelf being divided into a plurality of tracks for supporting different products, each track having a pivotal front member located at the front of the track.

Referring the drawings, and particularly to FIG. 1, there is illustrated a display rack 10. The display rack 10 comprises a base 12 and a back member 14 extending between two vertical posts 16. As illustrated, each of the posts 16 have a plurality of slots 18 therein adapted to receive projections (not shown) of a shelf assembly 20. Although two shelf assemblies are illustrated in FIG. 1, any number of shelf assemblies may be utilized in accordance with the present invention. Although only one type of base 12 and one type of back 14 are illustrated, others well-known in the industry may be used as well to support the shelf assemblies of the present invention.

One embodiment of shelf assembly 20 of the present invention comprises a shelf 22 having a bottom 24 and a plurality of dividers 26 extending from a back edge 28 of the shelf 22 to a front edge 30 of the shelf. A pair of the dividers 26 and the bottom 24 of the shelf 22 define a track 32. The track 32 supports a plurality of products 34 arranged in a column extending front to back. Within each column of products is a forwardmost product 34*a,* a second forwardmost product 34*b,* and a third most forwardmost product 34*c,* etc., depending upon how many bottles are in the column (see FIGS. 1 and 2). Although the dividers 26 are illustrated as being planar dividers, the dividers may take on alternative configurations as well.

Figure 2:
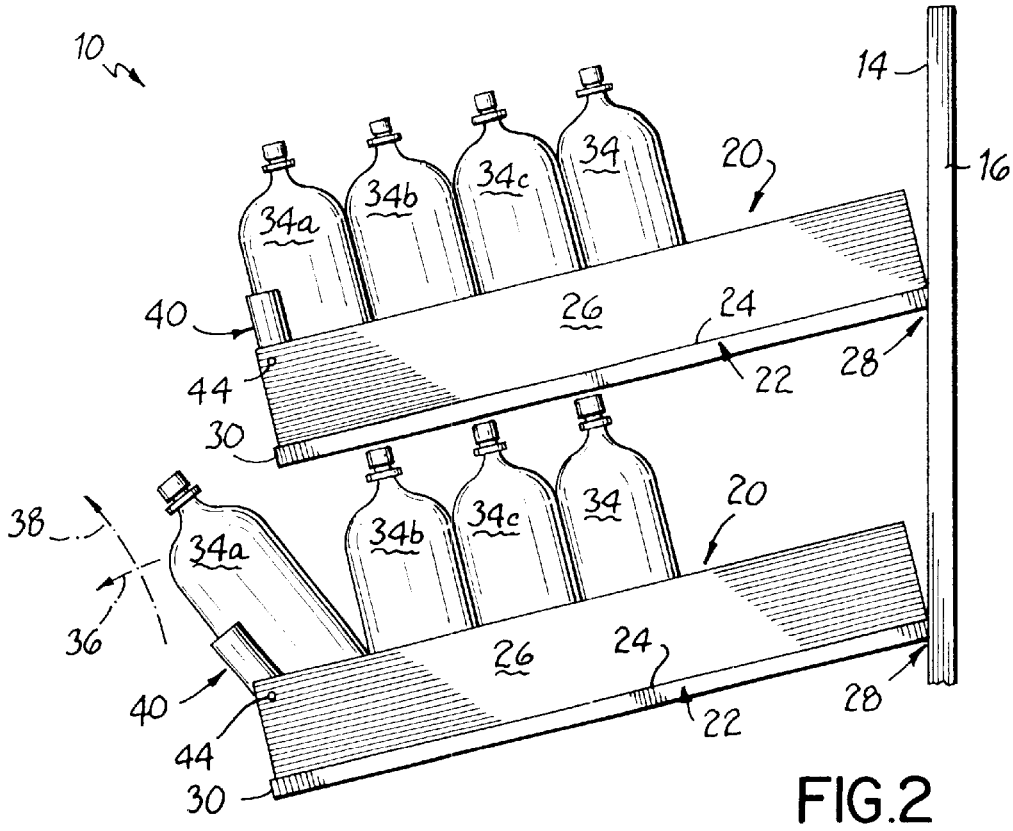
FIG. 2 is a side elevational view of a portion of the display rack of FIG. 1 showing the forwardmost bottle in a track being pulled forwardly off the shelf.

The shelves 22 are declined so that the front edge 30 of the shelf 22 is below the back edge 28 of the shelf 22 so that gravity feeds the products in the columns forwardly. This is best illustrated in FIGS. 1 and 2. The angle of inclination of the shelf determines the amount of force gravity will have on the product in order to push the product forwardly. Due to the inclination of the shelves, the product slides forwardly on the shelf until the forwardmost product in the column abuts against a bumper stop or other structure located at the front of the shelf preventing product from falling off the forward edge 30 of the shelf. If only one product is remaining in a track, that product will be located at the front of the track due to the inclination of the shelf (see top shelf of FIG. 1).

In accordance with the present invention, at the front of each track is a front member 40 which is movable relative to the dividers. More particularly, the front member 40 is pivotal about a horizontal axis, the horizontal axis being located above the bottom of the shelf (see axis A, in FIG. 1). Each front member 40 functions to prevent product from falling off the front of the shelf. Additionally, because the front member 40 may pivot about a horizontal axis, the forwardmost product 34*a* of a column of products with a track may be pulled forwardly in order to be removed.

Before the present invention fixed, immobile bumper stops, often pieces of wire, were placed at the front of the tracks on a shelf in order to prevent product from falling off the front of the shelf. When a customer desired to remove the forwardmost product of a column of products located within a track, the customer had to raise the forwardmost product upwardly so that the bottom of the product passed over the bumper stop. This required sufficient spacing between shelves. More particularly, shelves had to be vertically spaced from one another so that a significant gap existed between the top of the products located on one shelf and the bottom of the shelf immediately above it. Thus, the number of shelves that could fit within a fixed area was limited and the requisite space between shelves was wasted, i.e., it held no product.

The invention of the present application enables shelves to be placed closer together so that the bottom of one shelf may be located immediately above the top of the products resting on the shelf immediately below it (see FIG. 2). There is no wasted space between shelves. Therefore, a greater number of shelves may be located within a fixed area than has heretofore been possible.

As best illustrated in FIG. 2, because each front member of the present invention is pivotal about a horizontal axis, a consumer may remove the forwardmost product 34*a* of a column of products by pulling the top of the forwardmost product forwardly in the direction of arrow 36. Once the top of the forwardmost product 34*a* has been pulled forwardly, the forwardmost product 34*a* may then be pulled upwardly in the direction of arrow 38 in order to be removed from the track of the shelf assembly. The other products in the column may then slide forwardly in the track until the next forwardmost product 34*b* abuts the pivotal front member.

The pivotal front member 40 may take on numerous forms in accordance with the present invention. One embodiment is illustrated in FIG. 1, in which the front member 40 is pivotally secured to a pair of adjacent dividers 26 and is pivotal about a horizontal axis $A_1$. In this embodiment the front member 40 comprises an arcuate piece 42 and a single piece of wire 44. The arcuate piece 42 has a top edge 46, bottom edge 48 and side edges 50*a* and 50*b*. The arcuate piece 42 and the piece of wire 44 may be separate pieces as illustrated in FIG. 1, which may be glued or otherwise secured to one another so as to create a unitary front member 40. The arcuate piece 42 may have cutouts 52, which are sized so as to receive in a snap-fit manner the piece of wire 44. Alternatively, the piece of wire 44 and the arcuate member 42 may be one piece, integrally formed with one another. Other embodiments of front member 40 such as those illustrated and described in the remainder of this document may be used as well.

In this embodiment, the ends of each piece of wire 44 extend through holes 54 located at the front of the dividers 26 so as to enable the front member 40 to pivot about an axis $A_1$ defined by the aligned ends of the wire 44. Thus the front member 40 is pivotally engaged with a pair of adjacent dividers. As illustrated in FIG. 1, a forwardmost product 34*a* of a column of products within a track 32 may be pulled forwardly in the direction of arrow 56 in order to remove the forwardmost product 34*a* from the track without the forwardmost product 34*a* contacting the shelf immediately above it.

Figure 3:
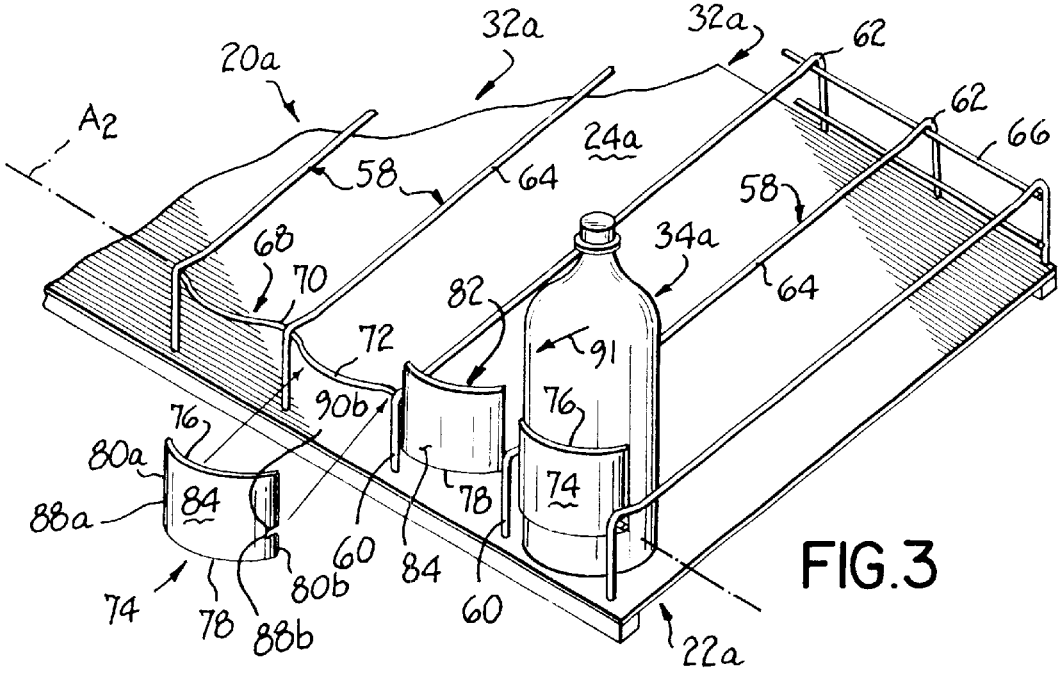
FIG. 3 is a perspective view of one embodiment of shelf assembly of the present invention having wire dividers, a fixed stop secured to the wire dividers at the front of the dividers, and a plurality of front members pivotally secured to the fixed stop.

Turning now to FIG. 3, an alternative embodiment of shelf assembly is illustrated. This embodiment is illustrated in more detail in FIGS. 8 and 8A. This embodiment of shelf assembly 20*a* comprises a shelf 22*a* having a generally planar shelf bottom 24*a*. This embodiment of shelf assembly also has a plurality of wire dividers 58 extending from the back of the shelf forwardly to the front of the shelf. Each wire divider 58 has a generally inverted U-shape and may be secured to the shelf bottom 24*a* in any number of ways, including that disclosed in applicant's own U.S. Pat. No. 5,119,945. Each divider wire 58 has a generally vertical front portion 60, a generally vertical rear portion 62 and a middle portion 64 connecting the front and rear portions. Extending between the wire dividers 58 is a back connector wire 66 and a wire stop 68. The wire dividers 58 function in the same manner as the planar dividers 26 illustrated in FIGS. 1 and 2. A pair of wire dividers 58 and the shelf bottom 24 define a track 32*a*. As best illustrated in FIG. 8, the wire stop 68 is welded or otherwise fixedly secured to the upper front corners of the wire dividers 58.

Figure 8:
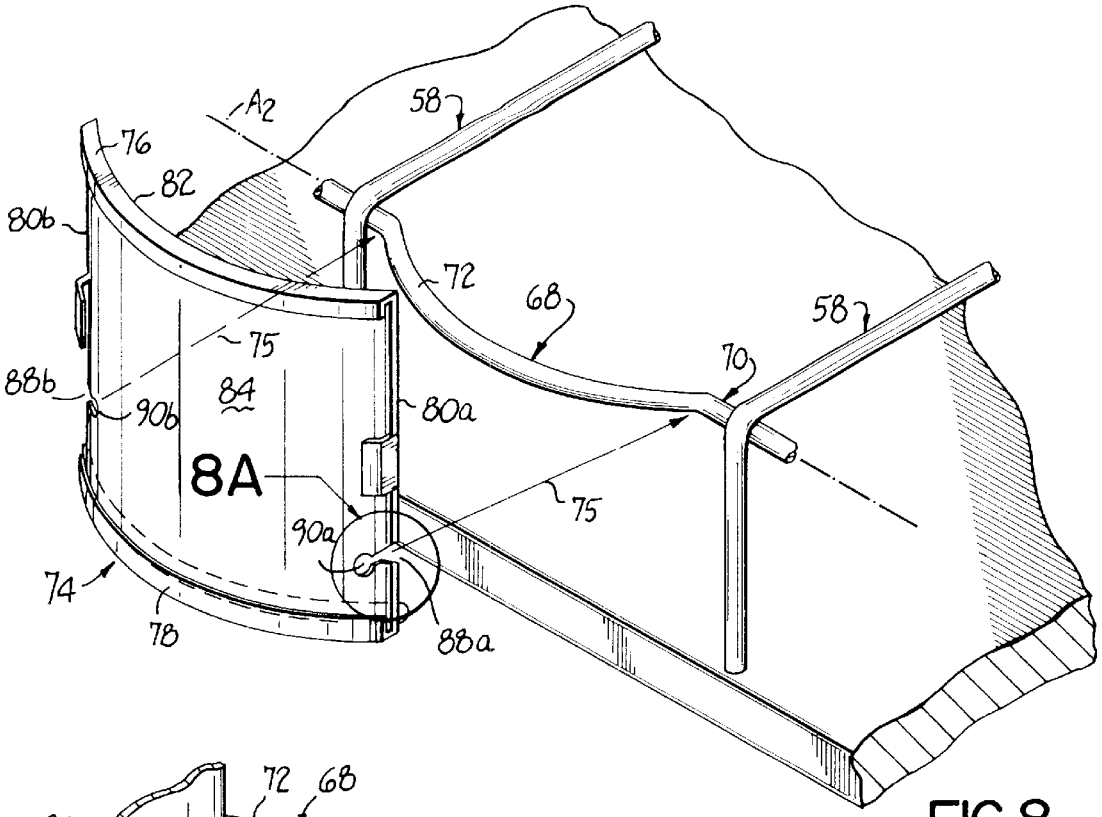
FIG. 8 is a partially disassembled view of an embodiment of front member having openings therein adapted to engage a fixed wire stop located at the front of the shelf.

As best illustrated in FIG. 8, this embodiment of shelf assembly further comprises a front member 74 located at the front of each track. Each front member 74 has a top edge 76, bottom edge 78 and a pair of opposed side edges 80*a*, 80*b*. The front member 74 is generally arcuate and adapted to receive a forwardmost product such as a beverage container. The front member 74 has a concave inner surface 82 and a convex outer surface 84, and is adapted to receive a product identifying element 86 (see FIG. 5). The product identifying element 86 may be a card, a label or any other element which identifies the product located in the track behind the pivotal front member. Further, as described in more detail below, the front member 74 may hold and display the product identifying element 86 any number of ways.

As illustrated in FIG. 8, the wire stop 68 has a plurality of aligned straight portions 70 and a plurality of curved portions 72 located between the straight portions 70. The straight portions 70 of the wire stop 68 define a horizontal axis $A_2$. The wire dividers 58 are welded or otherwise secured to the straight portions 70 of the wire stop 68. Although one form of wire stop 68 is illustrated, others may be used as well in accordance with the present invention.

Figure 8A:
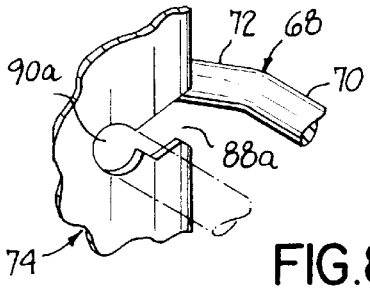
FIG. 8A is a view of the encircled area 8A of FIG. 8.

As best illustrated in FIG. 8A, the front member 74 has a pair of cutout portions 88*a*, 88*b*, each cutout portion including a circular opening 90*a*, 90*b*, respectively. The cutout portions 88*a*, 88*b* enable the wire stop 68 to be snapped into the openings 90*a*, 90*b* so as to enable the front member 74 to pivot about the wire stop. The front member 74 is moved in the direction of arrows 75 before the wire stop 68 passes through cutout portions 88*a*, 88*b* into openings 90*a*, 90*b*. Once the wire stop 68 is in openings 90*a*, 90*b*, the front member 74 may pivot about an axis $A_2$ defined by the straight portions 70 of the wire stop.

With the embodiment illustrated in FIGS. 3, 8 and 8A, when a user wants to remove a forwardmost product of a column of products within a track, the user pulls the top of the forwardmost product in the track 32*a* in direction of arrow 91 (see FIG. 3), causing the front member 74 to rotate about the axis $A_2$ defined by the straight portions 70 of the wire stop. The top of the front member 74 moves forwardly, while the bottom edge of the front member 74 moves rearwardly. The forwardmost product 34*a* then passes over the top of the arcuate portion 72 of the wire stop 68 before the forwardmost product 34*a* is entirely removed.

Figure 4:
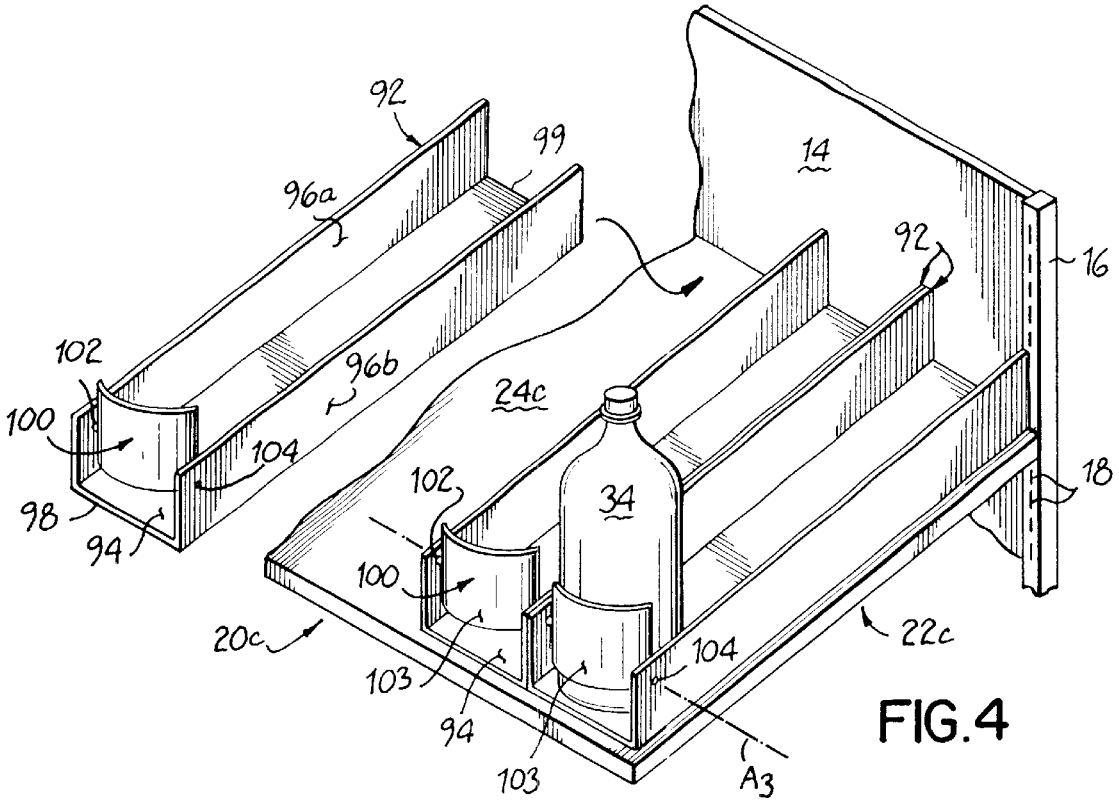
FIG. 4 is a perspective view of another embodiment of shelf assembly having a plurality of product holders located on a planar shelf, each product holder having a pivotal front member.

FIG. 4 illustrates another embodiment of shelf assembly 20*c* in accordance with the practice of the present invention. This embodiment of shelf assembly also utilizes a shelf 22*c* having a generally planar bottom 24*c* on which are placed a plurality of parallel generally U-shaped product holders 92. The shelf 22*c* may have an upwardly turned lip (not shown) so as to prevent the product holders 92 from falling off the shelf. Each product holder 92 comprises a bottom 94 and a pair of sidewall dividers 96*a*, 96*b*, which extend upwardly from the bottom 94 forming a generally U-shaped or channel-shaped product holder 92. The product holder 92 has a front edge 98 and a rear edge 99. The distance between the front edge 98 and the rear edge 99 defines the longitudinal dimension of the product holder. The product holder 92 may be made of plastic, metal or any other material. Additionally, the product holder 92 may be coated with a second material to increase the slipperiness of the product holder 92. The two sidewall dividers 96*a*, 96*b* and the bottom 94 of the product holder 92 form a track extending from back to front of the shelf adapted to receive a variety of products 34 arranged in a column (only one of which is shown in FIG. 4). A pivotally movable front member 100 is located at the front of each product holder.

FIG. 4 illustrates one type of front member 100 having projections 102 extending outwardly from the body 103 of the front member 100 and engaging holes 104 formed in the sidewall dividers so as to make the front member 100 pivotal about an axis $A_3$ defined by the projections. This embodiment of front member is similar to the embodiment illustrated in FIG. 1. The projections 102 may be pieces of wire, plastic or any other material, and may be integrally formed with the arcuate portion or body 103 of the front member, or may be separately formed and attached. Although not illustrated in FIG. 4, a fixed stop may be secured to the sidewall dividers 96*a*, 96*b* of the product holder 92 which does not rotate with the front member 100 (like the embodiment illustrated in FIGS. 3, 8 and 8A). A front member like front member 74 illustrated in FIGS. 8 and 8A would then be secured to the fixed stop which would pivot about a horizontal axis defined by the stop.

Figure 5:
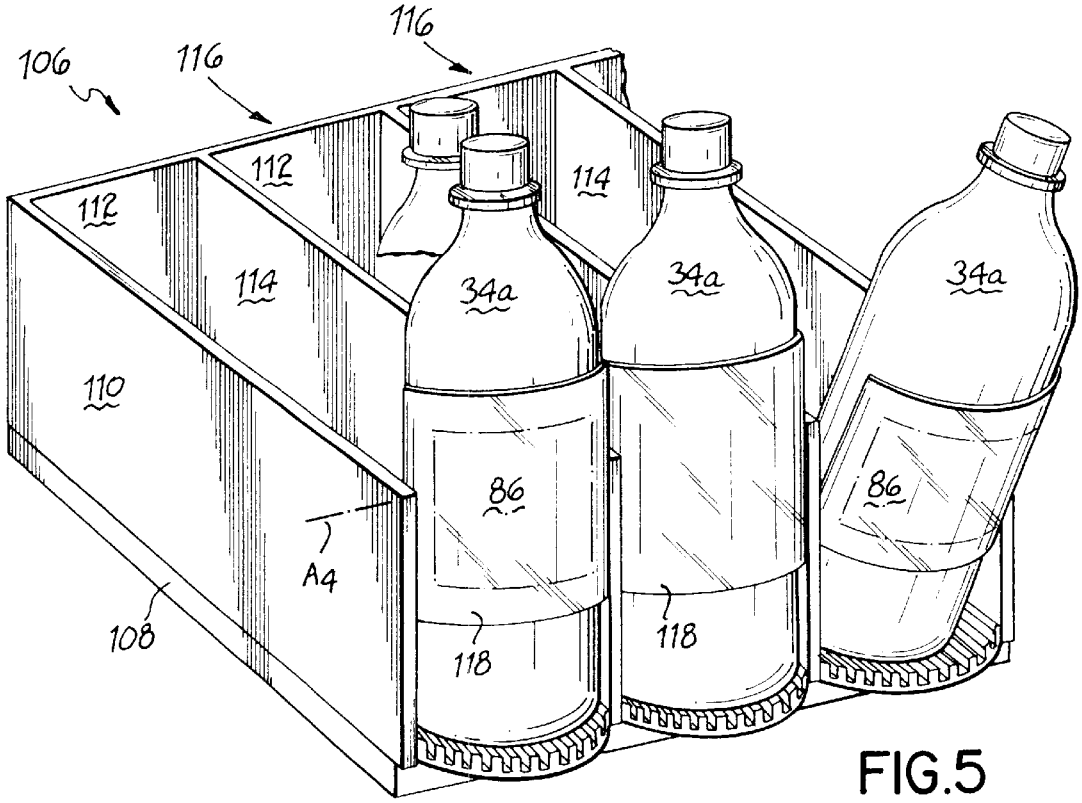
FIG. 5 is a perspective view of a shelf insert made in accordance with the present invention, the shelf insert having a plurality of pivotal front members pivotally engaged with dividers at the front of the insert.

Turning now to FIG. 5, there is illustrated a shelf insert 106 which is adapted to be placed on a generally planar shelf, such as that illustrated in FIG. 4. The shelf insert 106 comprises a bottom 108, a pair of outermost sidewalls 110 (only one shown) extending upwardly from the outward edges of the bottom 108 and a back wall 112. Parallel the sidewalls 110 are a plurality of internal dividers 114 extending forwardly from the back wall. A pair of dividers and the bottom of the shelf insert define a track 116 containing a column of products 34 arranged in a linear fashion front to back. The forwardmost product 34*a* within a column of products is prevented from falling off the front of the shelf by a pivotal front member 118. The front member 118 is capable of pivoting about a horizontal axis $A_4$ so as to enable the forwardmost product 34*a* within a column of products to be removed by pulling the forwardmost product 34*a* forwardly rather than lifting it upwardly. The front member 118 may be pivotally secured to a pair of dividers any number of ways mentioned hereinabove. For example, a pair of projections extending outwardly from the front member may be inserted into holes in the dividers. Additionally, a fixed stop may be secured to adjacent dividers and the front member pivot about the fixed stop as was described above and illustrated in FIGS. 3, 8 and 8A.

Figure 6:
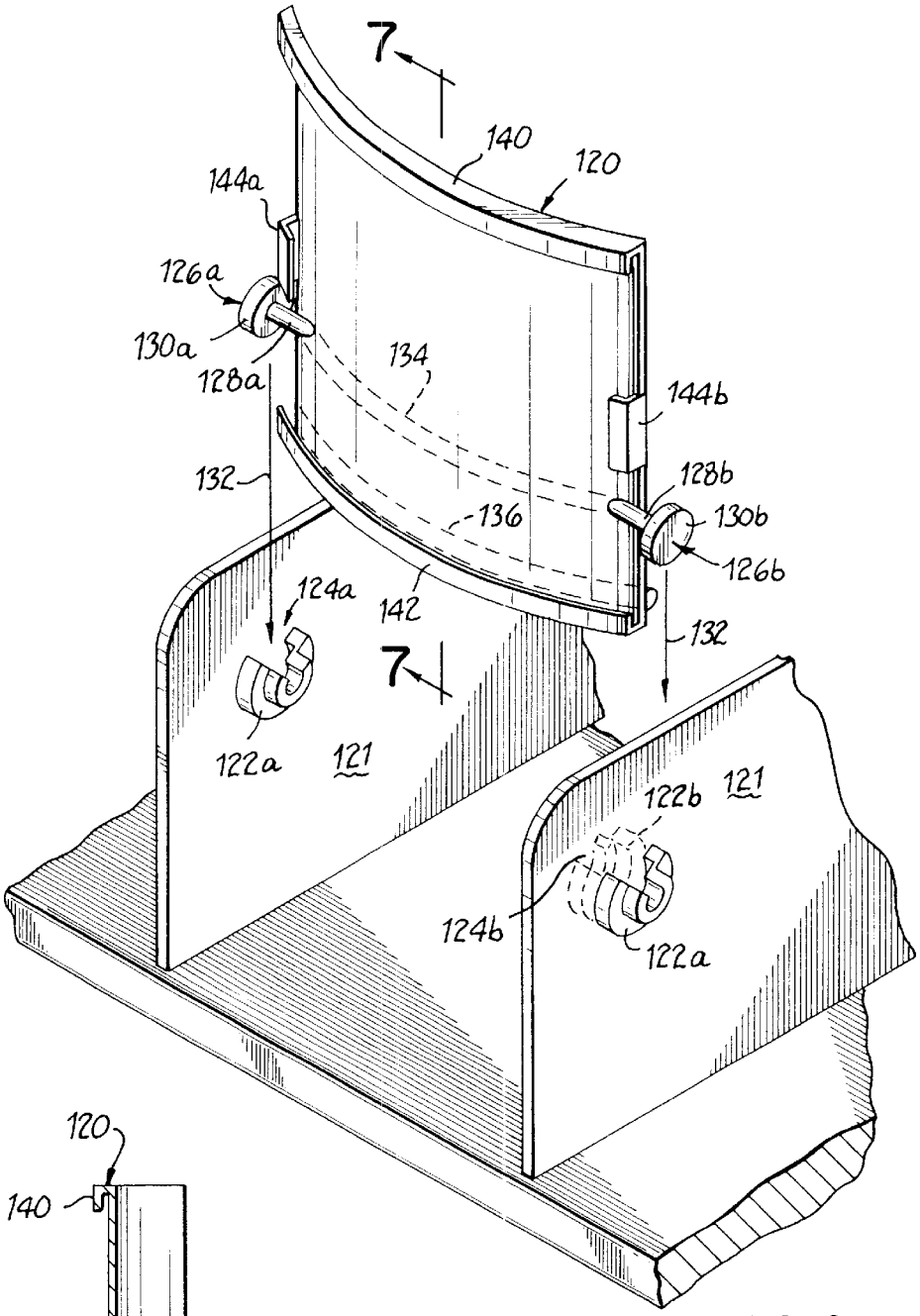
FIG. 6 is a partially disassembled view of one embodiment of front member having projections adapted to be engaged with receptacles integrally formed in the dividers.

FIG. 6 illustrates an alternative structure which may be used in order to secure a pivotal front member 120 to a pair of adjacent dividers 121 in order to prevent product from falling off the front of the shelf. In this embodiment each divider 121 has a pair of receptacles 122*a* (illustrated in solid lines) and 122*b* (illustrated in dashed lines) integrally formed with the divider. Alternatively, these receptacles 122*a* and 122*b* may be separately formed from the dividers and secured to the dividers in the proper location. One of the receptacles 122*a* is located on one side of the divider (to the right as illustrated in FIG. 6), while the other receptacle 122*b* is located on the opposite side of the divider (to the left as illustrated in FIG. 6). Each receptacle 122*a*, 122*b* has an open portion 124*a*, 124*b*, respectively, which enables a portion of the front member 120 to slide down into engagement with the receptacle.

The pivotal front member 120 has a pair of projections 126*a*, 126*b* extending outwardly from the front member 120. Each projection 126*a*, 126*b* has a shank 128*a*, 128*b* and an end portion 130*a*, 130*b* which is generally circular. In order to pivotally engage the front member 120 with a pair of dividers 121, and more particularly the receptacles 122*a*, 122*b* of the dividers, the projections 126*a*, 126*b* are moved downwardly in the direction of arrows 132 until the end portions 130*a*, 130*b* of projections 126*a*, 126*b* pass through the openings 124*a*, 124*b* in the receptacles. Once so engaged, the front member 120 will pivot about an axis defined by the shanks 128*a*, 128*b* of the projections 126*a*, 126*b*.

Figure 7:
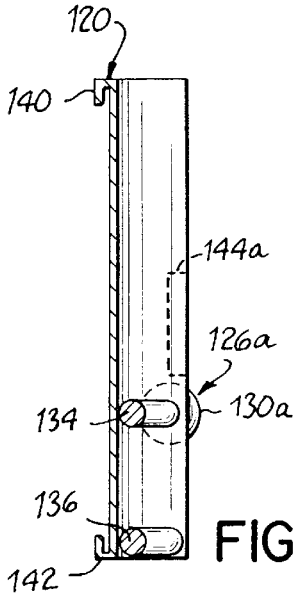
FIG. 7 is a view taken along the line 7—7 of FIG. 6.

As illustrated in FIGS. 6 and 7 the shanks 128*a*, 128*b* of the front member 120 may be connected together with a connector 134, which may be wire or a piece of plastic or any other material. Below and generally parallel the connector 134 is a bumper 136, illustrated in dashed lines in FIG. 6 but shown as a solid member in FIG. 7. The purpose of the bumper 136 is to provide an even surface with the connector 134 so that when the forwardmost product 34*a* moves forwardly and contacts the front member, the forwardmost product will not pivot about connector 134, but instead contact an even surface, thereby stabilizing the forwardmost product while the forwardmost product is engaged with the concave inner surface of the front member.

The pivotal front member of the present invention may take on numerous configurations, and this application is not intended to limit the configuration of the pivotal front member. For example, the projections 126*a*, 126*b* of the front member 120 may take on alternative configurations other than the configuration illustrated in FIG. 6.

FIG. 6 illustrates one configuration of front member 120 which is adapted to receive and display different product identifying elements so as to identify product within a track. Oftentimes as product moves down a track toward the front of the track the product may rotate, causing the label on the product to move into a position in which it is not easily visible by the consumer. Therefore, the consumer has to grab the forwardmost product and rotate it in order to identify the product. The present invention incorporates a front member adapted to receive and display different product identifying elements so that all the product within a specific track may be easily identified by the customer by simply looking at the pivotal front member. The customer need not turn the forwardmost product of a column of products in order to identify product within the track.

One embodiment of front member which accomplishes these objectives is illustrated in FIG. 6. The generally arcuate front member 120 has an upper lip 140, a lower lip 142 and two opposed side lips 144*a*, 144*b*, all of which help retain a product identifying element on the outer surface of the front member where a consumer may easily view the product identifying element. A product label or piece of cardboard, for example, identifying a particular product may be inserted between the upper and lower and two side lips. The lips hold the product identifying element in place until it is to be removed and replaced. This structure enables different product identifying elements to be easily inserted and removed if the merchant desires to change product within the track behind the front member. Other structures not illustrated may be used to retain a product identifying element with a pivotal front member such as, for example, that illustrated in FIG. 9.

Figure 9:
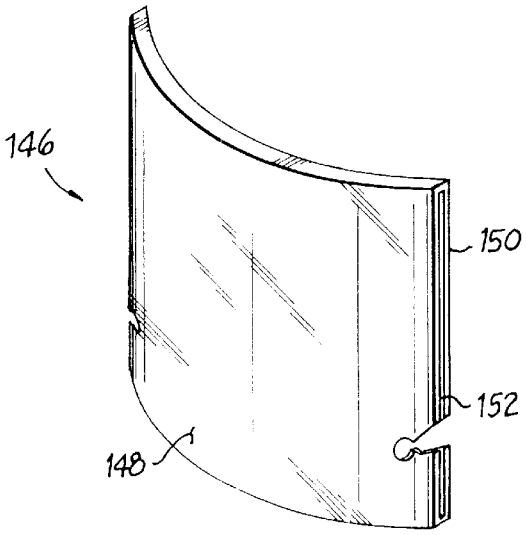
FIG. 9 is a perspective view of an alternative embodiment of front member.

FIG. 9 illustrates an alternative form of front member 146 which comprises simply two plies of material, an outer ply 148 and an inner ply 150. Between the inner and outer plies is a narrow space 152 into which a product identifying element may be inserted. Preferably, the material of the front member is clear plastic or any other type of material through which the product identifying element may be seen. Other forms of front member (not illustrated) which are adapted to hold and display different product identifying elements so that the product identifying elements may be changed as product is changed within a track may also be utilized in accordance with the present invention.

With the invention of the present application, one shelf may be placed immediately above an adjacent lower shelf because a forwardmost product in a track on the lower shelf may be removed by pulling the forwardmost product forwardly rather than lifting the forwardmost product vertically. Therefore, more shelves may placed within a finite area than heretofore possible, increasing the number of products which may be displayed within that area and reducing the frequency of restocking the shelves.

While we have described several preferred embodiments of the shelf assembly of the present invention, persons skilled in the art will appreciate changes and modifications which may be made to the present invention without departing from the spirit of the invention of this application. For example, other structures of pivotal front members may be pivotally secured to dividers at the front of a shelf assembly. Therefore, we intend to be limited only by the scope of the following appended claims.

We claim:

1. A shelf assembly for organizing and merchandising a plurality of products, said shelf assembly comprising:

an inclined gravity feed shelf, a plurality of product holders extending from front to back on said shelf, each of said product holders being independently removable from said shelf and comprising a bottom and a pair of sidewall dividers extending upwardly from said bottom, said bottom and said sidewall dividers defining a track, said track being adapted to support a plurality of products arranged in a column, and an arcuate front member supported by said pair of dividers, said front member being pivotal about a horizontal axis, said horizontal axis being positioned such that as a forwardmost one of said products is removed from said track by pulling a top portion of said forwardmost one of said products over said front member, said front member is caused to pivot about said horizontal axis and move a top edge of said front member forwardly so as to enable said forwardmost one of said products to be moved forwardly over said front member.

2. The shelf assembly of claim 1 wherein said front member is caused to return to its original position upon a product behind said forwardmost one of said products sliding forwardly on said shelf and contacting said front member.

3. A shelf assembly for organizing and merchandising a plurality of products, said shelf assembly comprising:

an inclined gravity feed shelf, a plurality of product holders extending from front to back on said shelf, each of said product holders being independently removable from said shelf and comprising a bottom and a pair of sidewall dividers extending upwardly from said bottom, said bottom and sidewall dividers defining a track, said track being adapted to support a plurality of products arranged in a column, and an arcuate front member supported by said pair of dividers, said front member being pivotal about a horizontal axis, said front member preventing product from falling off a front edge of said shelf, whereby upon a forwardmost product in said column of products being pulled over said front member, top and bottom edges of said front member are caused to rotate about said horizontal axis.

4. The shelf assembly of claim 3 wherein said top edge of said front member rotates in front of said horizontal axis when said forwardmost one of said products is removed from said track.

5. The assembly of claim 3 wherein said bottom edge of said front member rotates behind said horizontal axis when said forwardmost one of said products is removed from said track.

6. A shelf assembly for organizing and merchandising a plurality of products, said shelf assembly comprising:

an inclined gravity feed shelf, a plurality of product holders supported by said shelf, each of said product holders being independently removable from said shelf and comprising a bottom and a pair of sidewall dividers extending upwardly from said bottom, said bottom and said sidewall dividers defining a track, said track being adapted to support a plurality of products arranged in a column, and an arcuate front member supported by said pair of dividers, said front member being pivotal about a horizontal axis and having top and bottom edges located respectively above and below said horizontal axis such that upon a forwardmost one of said products being pulled over said front member, said front member is caused to pivot about said horizontal axis and in the course thereof, said bottom edge of said front member is moved rearwardly in said track and said top edge of said front member is moved forwardly.

* * * * *